United States Patent [19]

Slovinsky et al.

[11] 4,107,030

[45] Aug. 15, 1978

[54] ANTIFOULANTS FOR CRUDE OIL

[75] Inventors: Manuel Slovinsky; Dodd Wing Fong, both of Woodridge, Ill.

[73] Assignee: Nalco Chemical Company, Oak Brook, Ill.

[21] Appl. No.: 769,747

[22] Filed: Feb. 17, 1977

Related U.S. Application Data

[60] Continuation-in-part of Ser. No. 692,554, Jun. 3, 1976, abandoned, which is a continuation of Ser. No. 550,874, Feb. 19, 1975, abandoned, which is a division of Ser. No. 491,011, Jul. 23, 1974, abandoned.

[51] Int. Cl.[2] ..... C10G 9/16

[52] U.S. Cl. ..... 208/48 AA

[58] Field of Search ..... 208/48 AA

[56] References Cited

U.S. PATENT DOCUMENTS

| | | | |
|---|---|---|---|
| 2,205,948 | 6/1940 | Flett | 260/512 |
| 3,328,283 | 6/1967 | Godar | 208/48 AA |
| 3,328,284 | 6/1967 | Godar | 208/48 AA |

OTHER PUBLICATIONS

Püschel et al., Tenside, 5, 193 (1968).

*Primary Examiner*—Delbert E. Gantz
*Assistant Examiner*—Joan Thierstein
*Attorney, Agent, or Firm*—John G. Premo; Robert A. Miller; John S. Roberts, Jr.

[57] ABSTRACT

As antifoulants in the processing of crude oil to minimize deposition of condensates and polymeric deposits on heat exchangers, compounds of the following structure have been utilized:

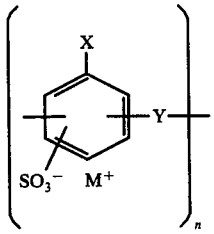

X = OH, $NH_2$, NHR, $NHCH_2CHOHR$ (R = straight or branched chain alkyl containing 2 to 20, preferably 6 to 16, carbon atoms.)

Y = H, $CH_2$

M = ammonia, amine containing 1–54 carbons where the total number of carbon atoms in X and M is $\geqq$ 8 but $\leqq$ 54.

$n \geqq 1$

As preferred compounds, sulfanilic acid amine salts are preferred in the above formula where X = $NH_2$, NHR, $NHCH_2CHOHR$.

Also preferred are phenolic compounds which are sulfonated and subsequently partially or completely neutralized with amines as in the above formula where X = OH.

The compounds show an effective dosage range from about 40 ppm to 300 ppm and the effective percent reduction in fouling in crude oils ranging from 42–94%.

7 Claims, No Drawings

ANTIFOULANTS FOR CRUDE OIL

This is a continuation-in-part application of pending Ser. No. 692,554, filed June 3, 1976, now abandoned which was a continuation of Ser. No. 550,874 filed Feb. 19, 1975 (now abandoned), which was a division of Ser. No. 491,011 filed July 23, 1974 (now abandoned).

The present invention relates to a group of compounds which have been effective as antifoulants to minimize formation of deposits on heat exchangers which are operated at elevated temperatures as in the processing of crude oil. When the oil contacts the hot metal surfaces, there is a tendency for the oil to decompose or undergo a chemical reaction that manifests itself in the form of deposits or foulants. These deposits lower heat transfer coefficients and increase the pressure drop across the exchanger. In order to minimize or prevent foulant formation, chemical additives (antifoulants) have been used. The general structural formula for the present antifoulants may be described as follows:

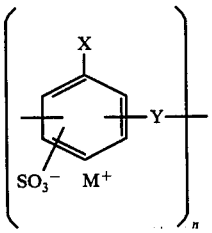

X = OH, $NH_2$, NHR, $NHCH_2CHOHR$ (R = straight or branched chain alkyl containing 2 to 20, preferably 6 to 16, carbon atoms.)

Y = H, $CH_2$

M = ammonia, amine containing 1–54 carbons where the total number of carbon atoms in X and M is $\geqq 8$ but $\leqq 54$.

$n \geqq 1$

In the above structure two preferred groups of compounds are as follows:

(1) certain sulfanilic acid amine salts, referring to the above formula wherein X = $NH_2$, NHR, $NHCH_2CHOHR$;

(2) phenol sulfonates, referring to the above formula wherein X = OH.

In the above, sulfanilic acid is insoluble in oil. To improve its oil solubility, two approaches have been used:

(1) neutralization of the sulfonic acid with an amine;

(2) N-alkylation of the sulfanilate with an olefin oxide. These reactions can be described as follows:

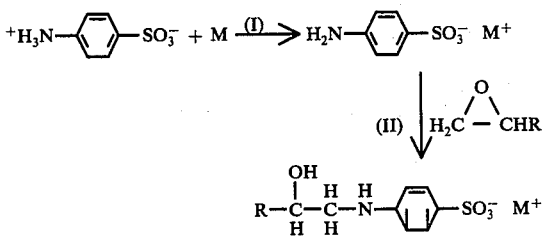

It has further been found that in the equations above the total number of carbon atoms in X and M should be $\geqq 8$ and $\leqq 54$. These compounds are generally soluble in aromatic solvents and in some isolated cases soluble in polar solvents such as dimethyl formamide. In reaction scheme II a suitable olefin oxide may be $C_{11-14}$ oxide, $C_{15-18}$ oxide, etc., generally selected from higher alkyl alpha olefin oxides.

In addition, condensates or polymers, specially of the phenolic compounds, are included in this invention as well as condensation products with the sulfanilic acid amine salts and aldehydes such as formaldehyde.

A further object is to provide a chemical treatment or method which will prevent the formation of and removal of high temperature deposits by petroleum hydrocarbon liquids in contact with heat transfer equipment.

PRIOR ART

The prior patented art relevant to the present invention is believed to be as follows:

I. Relative to the sulfanilic acid amine salts.

U.S. Pat. No. 3,437,583 Gonzalez (Betz Labs) — Teaches alkyl substituted phenols including nitrogen containing phenolic condensates as antifoulants.

II. Relative to the phenol sulfonates.

U.S. Pat. No. 3,105,810 Miller et al. (Nalco) — Discloses petroleum sulfonic acids and alkyl benzene sulfonic acids and salts at column 3, lines 5–21.

U.S. Pat. No. 3,328,284 Godar (Petrolite) — Teaches a mixture of an oxyalkylated phenolic compound and an organic sulfonate salt.

III. Relative to condensates.

U.S. Pat. No. 2,962,442 Andress (Socony Mobil) — Condensate is an amine-aldehyde with phenol.

U.S. Pat. No. 3,034,876 Gee et al. (Socony Mobile) — A condensation product of salicyl aldehyde and propylene diamine.

U.S. Pat. No. 3,132,085 Summers (Gulf Research) — A condensate of amine hydroxide-formaldehyde-alkyl phenol.

IV. Relative to tertiary-alkyl primary amines.

U.S. Pat. No. 3,224,957 Kent (Nalco)

V. References developed in the prior prosecution.

U.S. Pat. No. 2,205,948 Flett — Long-chain alkyl phenol sulfonates.

Scott et al. J. Chem. Soc., Perkin Trans. 1(21), pages 2663–6 (1972) — At page 2665 Runs 1, 8, and 9 teach amine salts of p-aniline sulfonates.

THEORY

This invention is also concerned with methods and processes of using the present compounds for preventing and removing deposits which are classed as foulants in the hot milieu of an oil heat exchanger.

It is believed that the present compounds act with a dual character as free radical scavengers as well as strong adsorbents, and they thus produce better antifoulant action than previously known compounds or compositions. The rationale of the adsorbent action on the surface of the heat exchanger is that the compounds bring radical scavenging moieties to the metallic site where most of the free radical thermal breakdown occurs and thus interfere with further free radical propagation and forming of fouling deposits. In the present invention phenol (and substituted phenol) sulfonic acid amine salts and sulfanilic acid amine salts seem to have the dual character of adsorbent (sulfonate group) and free radical scavenger (phenolic or anilinium) group.

SPECIFIC SULFANILIC ACID AMINE SALT COMPOUNDS

The sulfanilic acid salt compounds may be utilized in the free form but the N-alkylation of the sulfanilic acid salts greatly increases their oil solubility. In this connection it has been found that N-alkylation of the sulfanilic acid salts by reaction with an olefin oxide is specially helpful for oil solubility. These compounds are produced according to the equation below. In this stepwise reaction the $RNH_2$ is liberated in the first stage and the olefin oxide reacts with the amino group of the sulfanilic addition compound in the second stage.

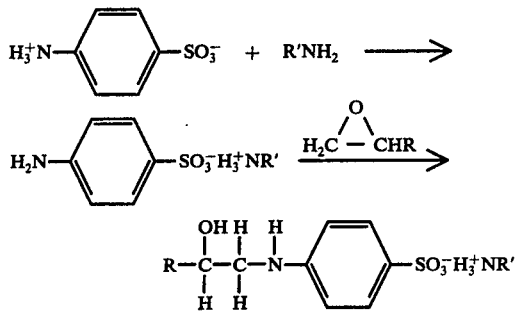

$R_2'NH$ and $R_3'N$ may also be used as reactant amines.

It has been further found that to achieve maximum effect of oil solubility in the above equation, the number of carbon atoms in R' or R' + R + 2 should be ≧ 8 and ≦ 54.

In the sulfanilic acid amine salt compounds, oligomers such as dimers result as where aniline reacts with formaldehyde in an acid medium to form a dimer

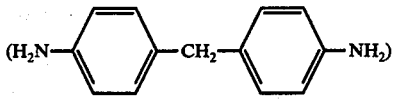

and polymers which are probably oligomers. Therefore, the structure of the type where $n > 1$ in the first formula results.

The preparation of the sulfanilic acid amine salt is achieved by reacting sulfanilic acid with the amine to free an aromatic amine from the inner salt.

In the above equation, the preferred reactant amine is a tertiary alkyl amine such as Primene 81R and Primene JM-T (Rohm and Haas). These Primene compounds, tertiary alkyl amines, are disclosed and taught in U.S. Pat. No. 3,224,957 ante and are also disclosed by the manufacturer as follows. In the manufacturer's technical bulletin dated September 1960, Primene 81R is disclosed principally as t-$C_{12}H_{25}NH_2$ to t-$C_{14}H_{29}NH_2$; and in a corresponding specification sheet SP-33 dated October 1956, Primene JM-T is disclosed at t-$C_{18}H_{37}NH_2$ to t-$C_{22}H_{45}NH_2$.

Specific preferred sulfanilic acid derived compounds which have been utilized, describing the amine used for neutralization of the sulfonic acid group and the α-alkylene epoxide used for N-alkylation, are as follows:

Sulfanilic acid-$NH_4OH$-$C_{15-18}$ epoxide
Sulfanilic acid-trimethylamine-$C_{15-18}$ epoxide
Sulfanilic acid-trimethylamine-$C_{11-14}$ epoxide
Sulfanilic acid-t-butylamine-$C_{15-18}$ epoxide
Sulfanilic acid-t-butylamine-$C_{11-14}$ epoxide
Sulfanilic acid-diethylamine-$C_{11-14}$ epoxide
Sulfanilic acid-diisobutylamine-$C_{11-14}$ epoxide
Sulfanilic acid-diisobutylamine-$C_{15-18}$ epoxide
Sulfanilic acid-2-ethylhexylamine-$C_{15-18}$ epoxide
Sulfanilic acid-2-ethylhexylamine-$C_{11-14}$ epoxide
Sulfanilic acid-Primene 81R-$C_{15-18}$ epoxide
Sulfanilic acid-Primene 81R-$C_{11-14}$ epoxide
Sulfanilic acid-Primene JM-T-$C_{15-18}$ epoxide
Sulfanilic acid-Primene JM-I-$C_{11-14}$ epoxide In the compounds above the following table shows the number of carbon atoms in M + R + 2 and the number of carbon atoms in R + 2 for the constituents of each sulfanilic acid R epoxide listed above.

TABLE I

| Number of Carbons in M + R + 2 | M | Number of Carbons in M | α-alkylene Epoxide | Number of Carbons in R + 2 |
|---|---|---|---|---|
| 15–18 | $NH_4OH$ | 0 | $C_{15-18}$ epoxide | 15–18 |
| 18–21 | trimethylamine | 3 | $C_{15-18}$ epoxide | 15–18 |
| 14–17 | trimethylamine | 3 | $C_{11-14}$ epoxide | 11–14 |
| 19–22 | t-butylamine | 4 | $C_{15-18}$ epoxide | 15–18 |
| 15–18 | t-butylamine | 4 | $C_{11-14}$ epoxide | 11–14 |
| 15–18 | diethylamine | 4 | $C_{11-14}$ epoxide | 11–14 |
| 19–22 | diisobutylamine | 8 | $C_{11-14}$ epoxide | 11–14 |
| 23–26 | diisobutylamine | 8 | $C_{15-18}$ epoxide | 15–18 |
| 23–26 | 2-ethylhexylamine | 8 | $C_{15-18}$ epoxide | 15–18 |
| 19–22 | 2-ethylhexylamine | 8 | $C_{11-14}$ epoxide | 11–14 |
| 27–32 | Primene 81R | 12–14 | $C_{15-18}$ epoxide | 15–18 |
| 23–28 | Primene 81R | 12–14 | $C_{11-14}$ epoxide | 11–14 |
| 33–40 | Primene JM-T | 18–22 | $C_{15-18}$ epoxide | 15–18 |
| 29–36 | Primene JM-T | 18–22 | $C_{11-14}$ epoxide | 11–14 |

In the compounds above the N-$C_{11-14}$ and $C_{15-18}$ hydroxy alkyl sulfanilic acid salts of 2-ethylhexylamine, Primene 81R, and Primene JM-T are soluble in aromatic solvents.

Additional sulfanilic acid amine salts which have not been N-alkylated and which are preferred are:

(1) di(tridecyl) amine salt of sulfanilic acid;

(2) methyl di(hydrogenated tallow) amine salt of sulfanilic acid;

(3) di(tridecyl) amine salt of sulfanilic acid condensed with formaldehyde; and (4) Primene 81R sulfanilic acid salt condensed with p-nonylphenol, formaldehyde, and oxalic acid as catalyst.

SPECIFIC EXAMPLES OF SULFONATED PHENOLIC COMPOUNDS

These phenolic compounds include monomeric and polymeric phenols and substituted phenols of the following structure:

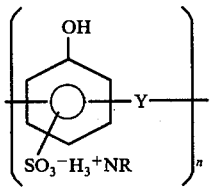

(R ≧ 8 but ≦ 54 carbon atoms
Y = H, $CH_2$
n ≧ 1

In the above formula, $H_3^+NR$ may be varied to $H_2^+NR_2$ and $H^+NR_3$. The sulfonic acid group can be in the ortho-, para-, or meta-position. The meta-orientation can be achieved where the o and p positions are tied up as in a polymer. The sulfonic acid is partially or completely neutralized with ammonia or amines where the amine can be primary, secondary, or tertiary, with carbon atoms ranging from 8–54.

The preparation of the monomeric phenol sulfonic acid antifoulants may be achieved easily because the phenol is readily sulfonated with concentrated sulfuric acid, fuming sulfuric acid, $SO_3$, or other common sulfonating agents and the salts are prepared by adding to the acid a desirable amount of ammonia, amine, or other bases.

The polymeric sulfonated phenolic antifoulants can be prepared in two ways:

(1) By polymerizing the phenol sulfonic acid or salt with formaldehyde or other aldehydes, or (2) By sulfonating a preformed phenolic resin. These procedures are well known in the prior art and polymers are generally achieved in the molecular weight range of 500 - 200,000.

Preferred compounds are the Primene 81R amine salt of phenol sulfonic acid (Example 5, post), the Primene 81R amine salt of nonylphenol sulfonic acid (Example 6), the Primene JM-T salt of phenol sulfonic acid (Example 7), and phenol-nonylphenol sulfonate condensate with formaldehyde and oxalic acid catalyst (Example 8).

DOSAGE

In the process of the present invention the effective dosage in use of the present compounds is generally in the range of 40–300 ppm. In some cases compounds are effective as antifoulants below 40 ppm and in practice the operable range for commercial purposes is in the broader range of 20-500 ppm.

EXAMPLE 1

Di(tridecyl) Amine Salt of Sulfanilic Acid

The di(tridecyl) amine salt of sulfanilic acid was prepared by mixing equal moles of the reactants in methanol at refluxing temperature. Toluene was added after dissolving all the sulfanilic acid and then methanol was distilled off. The product was soluble in toluene.

EXAMPLE 2

Methyl Di(hydrogenated tallow) Amine Salt of Sulfanilic Acid

The methyl di(hydrogenated tallow) amine salt of sulfanilic acid was prepared in the same way as described in Example 1. The product was only slightly soluble in cold aromatic solvents.

EXAMPLE 3

Di(tridecyl) Amine Salt of Sulfanilic Acid Condensed with Formaldehyde

A methanolic solution of di(tridecyl) amine salt of sulfanilic acid was first prepared. Then formaldehyde (90 mole % of the sulfanilic acid salt) was added and refluxed for 18 hours. Toluene was then added and methanol distilled. The product was soluble in toluene.

EXAMPLE 4

Primene 81R Sulfanilic Acid Salt Condensed with p-nonylphenol, Formaldehyde, and Oxalic Acid Catalyst A methanolic solution of Primene 81R sulfanilic acid salt (0.1 mole), p-nonylphenol (0.1 mole), formaldehyde (0.09 mole) and oxalic acid (0.3g) was refluxed for 18 hours. Then toluene was added and methanol distilled. The product was soluble in toluene.

EXAMPLE 5

Primene 81R Amine Salt of Phenol Sulfonic Acid

Concentrated sulfuric acid (49 g, 0.5 mole), diluted with 9 g of water was added dropwise into 47 g of phenol (0.5 mole) with stirring at 90° C. The reaction was continued at this temperature for a total of two hours. Then Primene 81R (106.5 g, 0.5 mole) in 200 ml of toluene was added. Any water present in the sample was distilled off azeotropically. The product was soluble in dimethyl formamide.

EXAMPLE 6

Primene 81R Amine Salt of Nonylphenol Sulfonic Acid

Concentrated sulfuric acid (19.6 g, 0.2 mole), diluted with 3.6 g of water, was added dropwise into 44 g of nonylphenol (0.2 mole) at 40°–55° C with stirring. After stirring at that temperature for three hours, Primene 81R (28 g, 0.2 mole) in 200 ml of toluene was added. Any water present in the sample was distilled off azeotropically. The product was soluble in toluene.

EXAMPLE 7

Primene JM-T Salt of Phenol Sulfonic Acid

Concentrated sulfuric acid (49 g, 0.5 mole), diluted with 9 g of water, was added dropwise into 47 g of phenol at 90° C with stirring. The reaction was continued at this temperature for a total of two hours. Water (100 ml), Primene JM-T (106.5 g, 0.33 mole), 37% aqueous formaldehyde (37.2 g, 0.46 mole), and then methanol (100 ml) were then added in sequence. The reaction mixture was then heated at refluxing temperature for three hours. Methanol was stripped off and then the water was azeotropically distilled with toluene. The product was soluble in 1-butanol.

EXAMPLE 8

Phenol-Nonylphenol Sulfonate Condensate with Formaldehyde and Oxalic Acid Catalyst Phenol (18.8 g, 0.2 mole), nonylphenol (88 g, 0.4 mole), 37% aqueous formaldehyde (40 g, 0.49 mole), and oxalic acid (0.5 g) were heated with stirring at a refluxing temperature for 30 minutes. Then an additional 0.5 g of oxalic acid was added and the reaction was continued for another hour. The resin formed was first washed with 150 ml of water and then separated and dried in vacuum.

Sulfonation was carried out by heating sulfuric acid (19.6 g, 0.2 mole) in 3.6 g of water and the resin at 90° C for three hours. The sulfonic acid was then neutralized with 42.6 g of Primene 81R (0.2 mole) in toluene. Any water present in the sample was distilled off azeotropically. The product was soluble in toluene.

EXAMPLE 9

The compounds of Examples 1–8 were evaluated for antifouling properties; Examples 1–4 in American CY blend desalted crude, Kuwait crude, or Light Arabian crude, and Examples 5–8 in CY blend desalted crude according to standardized tests such as those recited at Table 3 in U.S. Pat. No. 3,105,810, supra. The compounds utilized refer to those in the particular examples noted and described heretofore in this application.

TABLE II

Evaluation of Antifoulants in Different Crude Oils

| Sample | Crude Used | Additive Concentration ppm | % Reduction in Fouling |
|---|---|---|---|
| Example 1 | American CY Blend | 300 | 82 |
| | | 150 | 35 |
| | Kuwait | 300 | 93 |
| Example 2 | American CY Blend | 300 | 42 |
| Example 3 | American CY Blend | 300 | 80 |
| | Kuwait | 300 | 94 |
| Example 4 | Light Arabian | 300 | 62 |
| Example 5 | CY Blend Desalted | 75 | 78 |
| Example 6 | CY Blend Desalted | 75 | 46 |
| Example 7 | CY Blend Desalted | 75 | 87 |
| | | 37.5 | 36 |
| Example 8 | CY Blend Desalted | 75 | 78 |

We claim:

1. A method of preventing fouling on high temperature metal surfaces of oil heat exchangers by utilization at the metal surface an antifouling amount of a compound selected from the following formula:

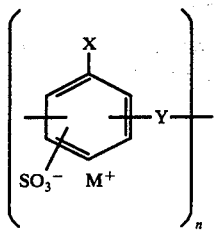

X = $NH_2$, NHR, $NHCH_2CHOHR$ (R = straight or branched chain alkyl containing 2 to 20, preferably 6 to 16, carbon atoms)

Y = H, $CH_2$

M = ammonia, amine containing 1–54 carbons where the total number of carbon atoms in X and M is $\geqq$ 8 but $\leqq$ 54 n $\geqq$ 1.

2. The method of claim 1 wherein X = $NH_2$.

3. The method of claim 1 wherein X is a member selected from the group consisting of NHR or $NHCH_2CHOHR$.

4. A method of preventing fouling and removing foulant from metal surfaces of oil heat exchangers at high temperatures which consists of applying in a dosage range of about 20–500 ppm to said metal surfaces a compound selected from the following formula:

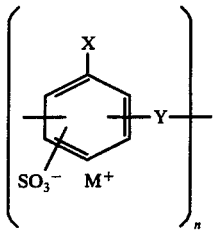

X = $NH_2$, NHR, $NHCH_2CHOHR$ (R = straight or branched chain alkyl containing 2 to 20, preferably 6 to 16, carbon atoms)

Y = H, $CH_2$

M = ammonia, amine containing 1–54 carbons where the total number of carbon atoms in X and M is $\geqq$ 8 but $\leqq$ 54 n $\geqq$ 1.

5. The method according to claim 4 wherein the dosage range is about 40–300 ppm.

6. The method according to claim 4 wherein X = $NH_2$.

7. The method according to claim 4 wherein X is a member selected from the group consisting of NHR or $NHCH_2CHOHR$.

* * * * *